United States Patent [19]

Jiam-Fa

[11] Patent Number: 5,056,186

[45] Date of Patent: Oct. 15, 1991

[54] CLEANER

[76] Inventor: Weng Jiam-Fa, 2nd Fl. 1, Sec. 2, Chung Yang Rd., San Chung, Taipei, Taiwan, Taiwan

[21] Appl. No.: 591,760

[22] Filed: Oct. 2, 1990

[51] Int. Cl.[5] ..... A47L 7/02

[52] U.S. Cl. ..... 15/328; 15/344

[58] Field of Search ..... 15/328, 344

[56] References Cited

U.S. PATENT DOCUMENTS

| | | | |
|---|---|---|---|
| 4,513,470 | 4/1985 | Toya | 15/328 |
| 4,574,419 | 3/1986 | Lex | 15/328 |
| 4,773,120 | 9/1988 | Wang | 15/344 |
| 4,798,613 | 1/1989 | Hetherington et al. | 15/344 X |
| 4,924,550 | 5/1990 | Wu | 15/328 |

*Primary Examiner*—Chris K. Moore

*Attorney, Agent, or Firm*—Morton J. Rosenberg; David I. Klein

[57] ABSTRACT

A combination cleaner is provided which combines both vacuum cleaning and brushing or waxing capabilities. All operative elements are contained within a main body (11) and driven by a motor (17) through a driving train and a clutch assembly (19). The vacuum cleaning portion of the combination cleaner includes a vacuum fan (18), as well as a filter net (16) located within a frontal hood (14) of the combination cleaner. Waxing brushes (21) are mounted on a bottom portion of the combination cleaner and the combination cleaner may be selectively used in accordance with a plurality of brushes. The cleaner provides both vacuum cleaning and waxing capabilities through actuation of the clutch assembly (19) for providing a multi-purpose and multi-effective combination cleaner being used at the discretion of an operator.

1 Claim, 3 Drawing Sheets

CLEANER

BACKGROUND OF THE INVENTION

1. Field of the Invention

The subject combination cleaner relates to a cleaning system particularly directed to providing both vacuum cleaning capabilities as well as waxing or brush cleaning capabilities. In particular, the subject combination cleaner provides for both a waxing brush connection as well as a suction inlet for vacuum cleaning. More in particular, this invention relates to a combination cleaner having a clutch mechanism contained therein which allows the user to select whether a vacuum cleaning operation or a brushing or waxing operation is needed. Still further, this combination cleaner system provides a multi-purpose and multi-cleaning system to optimize a brushing or cleaning operation as well as to being applicable to a vacuum cleaning objective.

2. Prior Art

Vacuum cleaning appliances and brush cleaning appliances are known in the art. However, prior art household appliances generally provide for either a brush cleaning system or a vacuum cleaning system for a single purpose. It is not believed that any of the prior art is multi-purpose or has multi-objective considerations as provided in the subject Patent Application system.

Prior art cleaning devices are widely applied to both domestic and commercial uses however, many prior art systems are complicated to use wherein the user must insert a plug of each particular device being used in a suitable socket and must store the device and power cord after a particular use. Such prior art systems are generally complicated in nature when vacuum cleaning and waxing jobs are to be conducted within a vehicle. The subject invention concept provides for a multi-purpose and multi-effect cleaner which is specifically directed to solving the above-mentioned defects and simplify any cleaning job as well as to allow a single system to be applicable to both waxing and vacuum cleaning in domestic, vehicle, or commercial use.

SUMMARY OF THE INVENTION

A combination cleaner including a hollow main body housing accommodating a filter net, a reversible motor, a draft fan and having a handle extending from a rear section of the hollow main body housing is provided. A frontal hood is releasably coupled to a front section of the hollow main body housing by a buckle with the frontal hood having a suction inlet. A clutch mechanism is provided which is located within the hollow main body housing for operating the combination cleaner as (1) a vacuum cleaner or (2) a brush cleaning apparatus. The clutch mechanism includes a worm gear coupled to an output shaft of the reversible motor and a driving gear for engagement and disengagement with the worm gear. The driving gear is reversibly displaceable by a pull rod member extending at least partially external the main body housing. The pull rod member has a hollow sleeve contour including an upper and lower groove formed within an external surface. The upper and lower grooves are engaged by the main body housing to maintain the clutch mechanism in a positionally stable location. The pull rod member has an inwardly directed flange member extending into a groove formed within an upper driving gear shaft extending from an upper end of the driving gear for constraining the pull rod member to the driving gear. The driving gear is coupled to a first gear through a lower driving gear shaft extending from a lower end of the driving gear. The first gear engages a second gear coupled to a brush member where the pull rod member is displaced to a position where the driving gear engages the worm gear. The clutch mechanism is engaged and drives the brush through mating engagement of the first and second gears.

One object of the present invention is to provide a multi-purpose cleaner having particular components easily mounted. Additionally, the multi-purpose and combination cleaner of the subject Patent Application is provided for a space saving consideration and is convenient to use. Additionally, the subject combination cleaner is applicable to both vacuum cleaning and waxing for a vehicle.

These and other objectives and advantages of the present system will become apparent to those skilled in the art after reading the detailed Specification together with the accompanying drawings.

DESCRIPTION OF THE PREFERRED EMBODIMENTS

Figure 1:
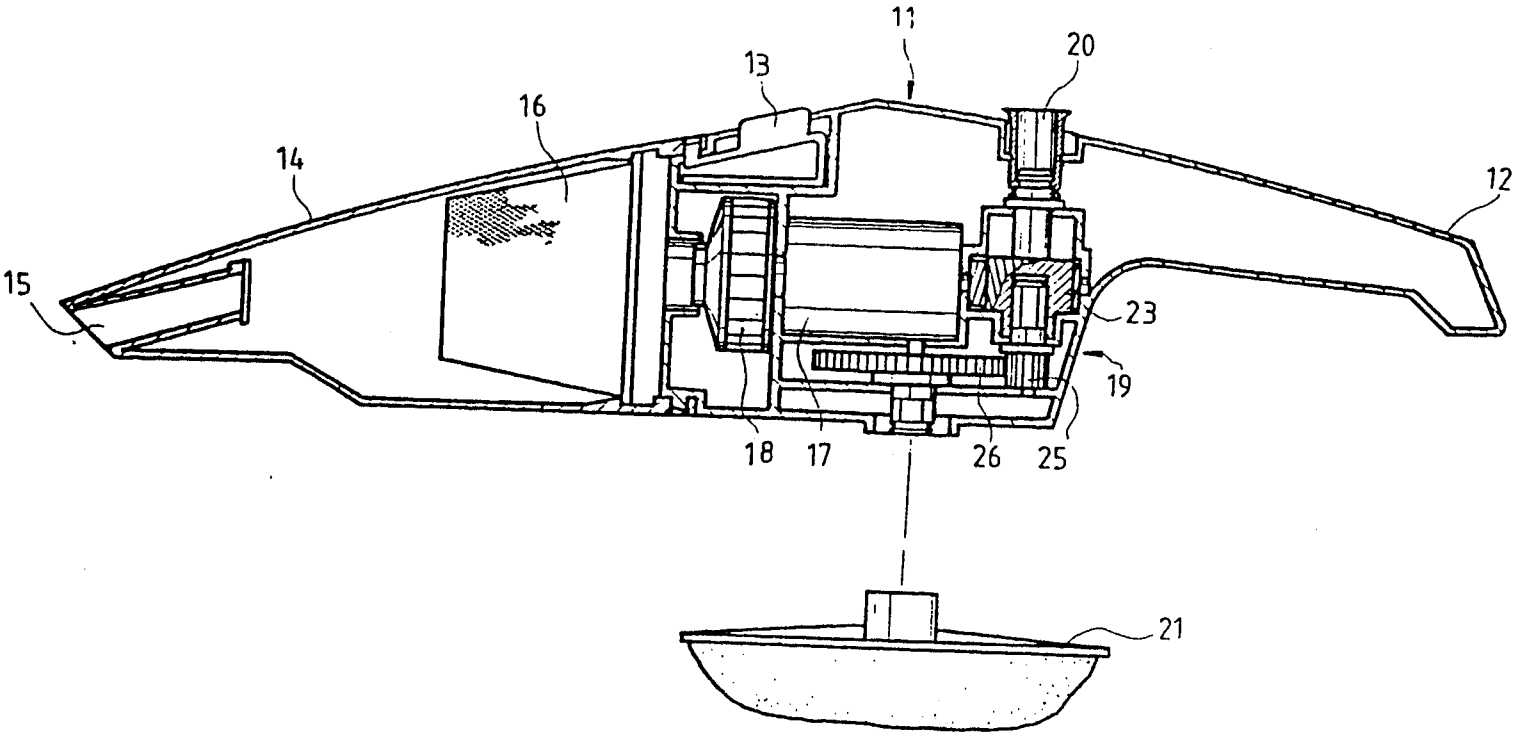
FIG. 1 is a sectional side view of a combination cleaner according to the present invention.

Referring now to FIGS. 1–4, the combination cleaner according to the present invention includes a main body 11 having handle 12. The leading or frontal end of main body 11 is coupled to a frontal hood 14 through a buckle mechanism 13. The leading end of frontal hood 14 includes a suction inlet 15 and the hollow main body 11 accommodates a filter net 16. A reversible output motor 17, a draft fan 18 and clutch mechanism 19 is included.

Clutch mechanism 19 is operated through pull rod member 20 on an upper portion to allow the main edge of main body 11 to accommodate and have coupled thereto various waxing brushes 21. Brush 21 shown in FIG. 1 is merely used for example purposes.

Referring to the combination cleaner, motor 17 is accommodated within main body 11 and is the main drive source for the vacuum cleaner and waxing machine in both modes of operation. When the leading end of main body 11 is engaged with frontal hood 14, output rotation at the end of motor 17 drives draft fan 18 whereby a vacuum condition is achieved within frontal hood 14 due to the driving high speed rotational force whereby a suction is developed.

Figure 3:
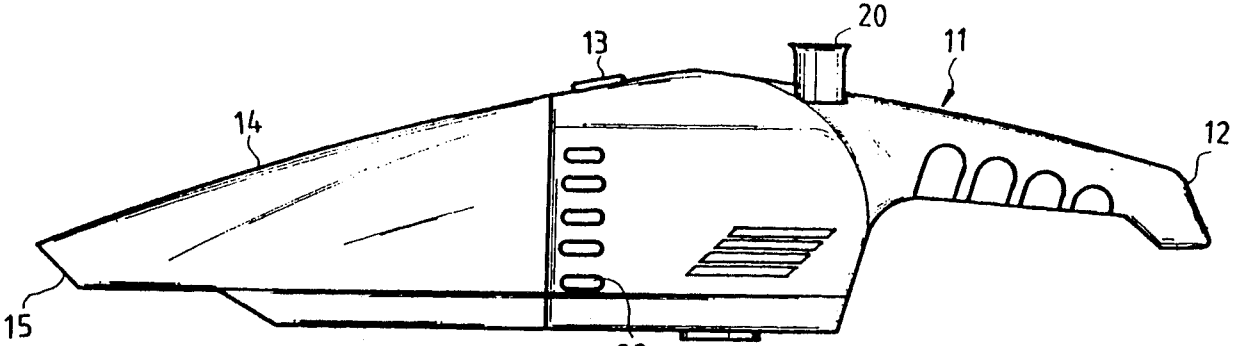
FIG. 3 is a side view of the combination cleaner of the subject invention concept being operative as a vacuum cleaner; and, FIG. 4 is a side view of the subject combination cleaner being operative as a waxing or brush driving system.

As in the case of standard vacuum cleaners, (as shown in FIG. 3), dust is drawn and concentrated within frontal hood 14 when air is passed from exhaust grooves 22 located at the side of filter net 16 and main body 11.

During the operation of vacuuming and drawing dust, the other output end of motor 17 connecting clutch assembly 19 is controlled by pull rod member 20 which keeps clutch assembly 19 at a separating idle run position. In this mode of operation, output power is not wasted. The present invention emphasizes the structure of clutch assembly 19 which is constructed for ease of operation to enable a main driving source with varying output power to be applicable to different kinds of motion.

Figure 2:
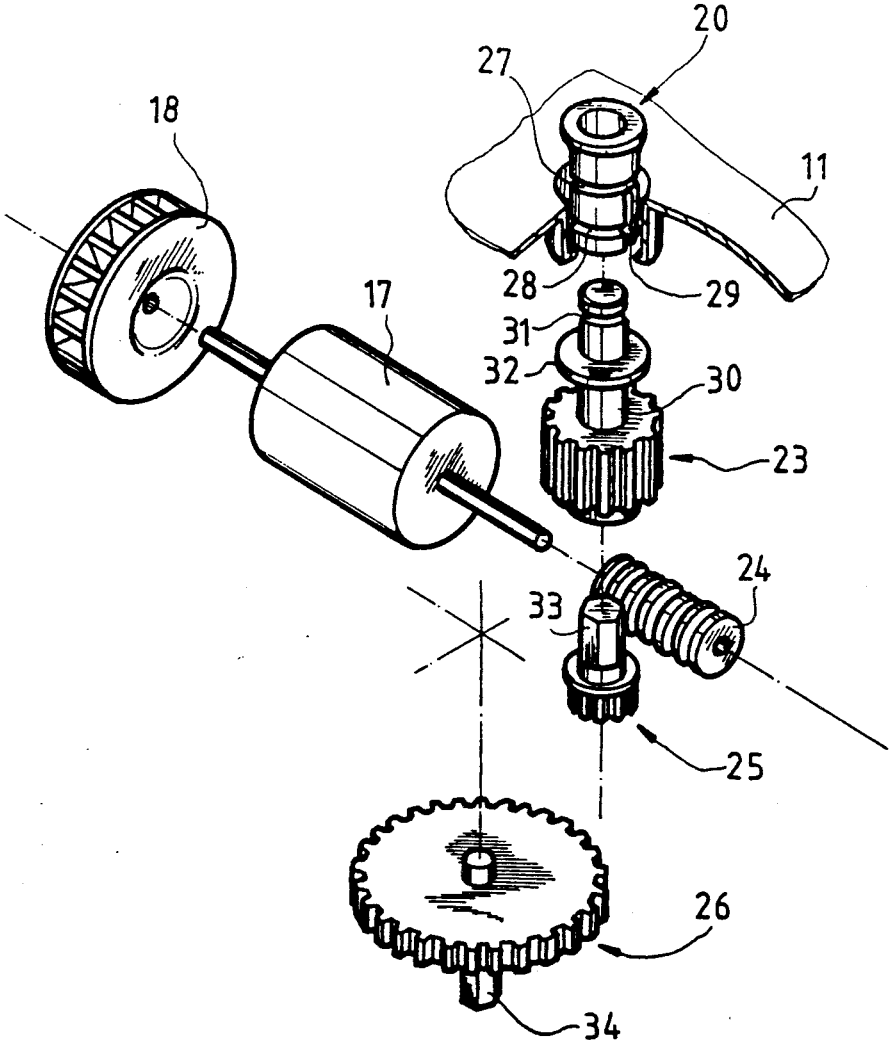
FIG. 2 is a perspective view of the clutch mechanism in blowout showing the clutch device according to the present invention.

Referring to FIG. 2, clutch assembly 19 includes pull rod member 20, drive gear 23, worm gear 24, first gear 25, and second gear 26. Worm gear 24 is coupled to the output shaft of motor 17 and is matingly engaged to driving gear 23. Driving gear 23 transmits power to first gear 25 and second gear 26 whereby motor 17 output rotation speed is reduced and torque is increased.

Still referring to FIG. 2, pull rod member 20 has a hollow sleeve contour. The outer edge of pull rod member 20 has an upper external groove 27 and lower external groove 28 formed therein. The bottom end of pull rod member 20 has an axial tangent groove 29 and an inner flange (not shown). Upper and lower external grooves 27, 28 are provided to releasably constrain pull rod member 20 to main body 11 and fix pull rod member 20 in a stable position when pull rod member 20 is pulled up and down. The axial tangent groove 29 provides the bottom of pull rod member 20 with a clamping force in order to fasten together the inner flange of the bottom of pull rod member 20 and driving gear 23.

Driving gear 23 is upwardly extending and provides shaft section 30. Shaft section 30 has a groove 31 formed at an uppermost portion provided to engage the inner flange formed on the bottom end of pull rod member 20 for coupling driving gear 23 to pull rod member 20. Driving gear 23 reversibly displaces in the vertical direction responsive to vertical displacement of pull rod member 20. Check plate 32 is provided to limit driving gear 23 to be displaced within a defined vertical displacement limit. The bottom edge of driving gear 23 has a hexagon shaft hole (not shown in FIG. 2) provided to interface with the shaft of first gear member 25 on the bottom end of driving gear 23.

As shown in FIG. 1, first gear 25 is geared to second gear 26. The upper end of first gear 25 has a hexagon gear shaft 33 provided to matingly engage with hexagon shaft opening formed on the bottom edge of driving gear 23. The bottom edge of second gear 26 has a gear shaft 34 provided to interface and matingly engage with various types of waxing brushes 21.

When all members of clutch assembly 19 are assembled, the structure of clutch 19 is constructed as shown in FIG. 1. When the combination cleaner is to be used as a vacuum cleaner, pull rod member 20 is displaced upwardly to displace driving gear 23 in an upward direction. Thus, driving gear 23 is separated from worm gear 24 (at that time, the bottom end of driving gear 23 remains interfaced with hexagon gear shaft 33 of the first gear 25) to form a clutch 19 operating in an idle state. External groove 28 formed in pull rod member 20 is fastened to the main body 11 (cabinet of combination cleaner) whereby the clutch 19 is constrained at a separating idle run state.

Figure 4:
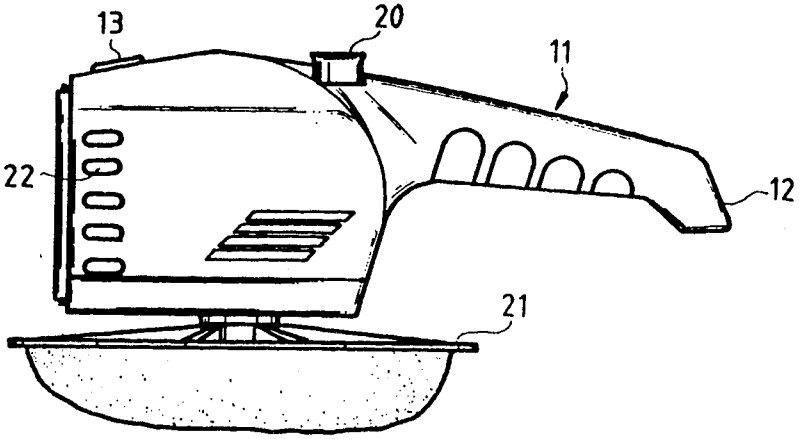

When it is intended to use the combination cleaner as a waxing machine, the buckle 13 is opened on main body 11 to remove the frontal hood 14. Waxing brush 21 is inserted on the bottom of main body 11 (gear shaft 34 or second gear 26 on bottom end of main body 11), and pull rod member 20 is pushed down. Driving gear 23 moves downwardly and engages worm gear 24 whereby clutch assembly 19 is changed from separating idle run state into gearing rotation state. Output power motor 17 through worm gear 24, gear seat 23, first gear 25 and second gear 26 reduces the rotation of motor 17 and thus promotes an increase in torque as well as driving waxing brushes 21 in rotation whereby combination cleaner is now useful as a waxing machine. In this state, clutch 19 operates at a gearing rotation state as shown in FIG. 4, since pull rod member 20 is pushed down to enable external groove 27 to be secured to main body 11. In the manner described above, the combination cleaner allows a single main body 11 and a single drive source to be applicable for various cleaning effects.

Clutch elements are made in diminished sizes to be inserted into the internal space of main body 11. Further, due to simplified construction members, defined motions of control and transmission are provided so that multi-purpose and optimized utility of combination cleaner as described above may be accomplished through the varying output power of a single main body 11 and main drive source.

In production, waxing brushes 21 may be made into an assembly consisting of some elements subject to required dimensions. A power switch to start motor 17 may be located at an appropriate position on handle 12 of main body 11 for convenience of operation. The present invention provides a space saving, simplified operation and cost effective structure that is an improvement in effectiveness relating to the defects found in prior art household cleaner appliances.

What is claimed is:

1. A combination cleaner including a hollow main body housing accommodating a filter net, a reversible motor, a draft fan and having a handle extending from a rear section of said hollow main body housing, a frontal hood releaseably coupled to a front section of said hollow main body housing by a buckle, said frontal hood having a suction inlet, wherein the improvement comprises:

clutch means located within said hollow main body housing for operating said combination cleaner as (1) a vacuum cleaner or (2) a brush cleaning apparatus, said clutch means including a worm gear coupled to an output shaft of said motor and a driving gear for engagement and disengagement with said worm gear, said driving gear being reversibly displaceable by a pull rod member extending at least partially external said main body housing, said pull rod member having a hollow sleeve contour including an upper and lower groove formed within an external surface thereof, said upper and lower grooves being engaged by said main body housing to maintain said clutch means in a positionally stable location, said pull rod member having an inwardly directed flange member extending into a groove formed within an upper driving gear shaft extending from an upper end of said driving gear for constraining said pull rod member to said driving gear, said driving gear coupled to a first gear through a lower driving gear shaft extending from a lower end of said driving gear, said first gear for engaging a second gear coupled to a brush member wherein when said pull rod member is displaced to a position where said driving gear engages said worm gear, said clutch means is engaged and drives said brush through mating engagement of said first and second gears.

* * * * *